US005169282A

United States Patent [19]

Ueda et al.

[11] Patent Number: 5,169,282

[45] Date of Patent: Dec. 8, 1992

[54] METHOD FOR SPREADING SHEETS

[75] Inventors: Atsushi Ueda; Hidetoshi Ishihara; Toshio Hattori, all of Nagoya; Hisashige Ichimoto; Koichi Ishida, both of Kyoto, all of Japan

[73] Assignees: Mitsubishi Jukogyo Kabushiki Kaisha; Watakyu Shingu Co., Ltd., both of Tokyo, Japan

[21] Appl. No.: 780,549

[22] Filed: Oct. 23, 1991

Related U.S. Application Data

[63] Continuation of Ser. No. 445,772, Dec. 4, 1989, abandoned.

[30] Foreign Application Priority Data

Dec. 2, 1988 [JP] Japan ..... 63-305714
Jun. 16, 1989 [JP] Japan ..... 1-153697

[51] Int. Cl.[5] ..... D06F 37/04

[52] U.S. Cl. ..... 414/786; 414/13; 38/7

[58] Field of Search ..... 414/13, 786; 38/2, 7-9, 38/143

[56] References Cited

U.S. PATENT DOCUMENTS 3,092,263 6/1963 Beaudry et al. .
3,092,271 6/1963 Beaudry et al. .
4,979,860 12/1990 Ueda et al. ..... 414/13 X
4,979,868 12/1990 Ueda et al. ..... 414/13 X

FOREIGN PATENT DOCUMENTS 0272368 6/1988 European Pat. Off. ..... 38/7
2336510 7/1977 France .
2646178 10/1990 France .
59-24685 6/1984 Japan .
211100 9/1987 Japan ..... 38/143
63-90614 6/1988 Japan .
63-104310 7/1988 Japan .
1556077 11/1979 United Kingdom .
2219313 12/1989 United Kingdom ..... 38/143

*Primary Examiner*—Michael S. Huppert
*Assistant Examiner*—William M. Hienz
*Attorney, Agent, or Firm*—Wenderoth, Lind & Ponack

[57] ABSTRACT

A method for spreading thin soft rectangular articles such as cloths, unwoven cloths, paper sheets, plastic sheets, etc. (generally called "rectangular sheets") is disclosed. A part of a first side of a rectangular sheet including one corner of a rectangular sheet is suspended in the air as held nearly horizontally by gripping the corner and another point on the side by grippers which are slidable on a horizontal rail. Accordingly, a second side of the rectangular sheet including the one corner is made to hang down nearly vertically. Then the lowermost end of the second side is gripped by another gripper that is movable vertically along a vertical rail. Except for the one corner, the initially held part of the one side is released, and the rectangular sheet is held with the two adjacent corners at the opposite ends of the second side gripped by two grippers which are movable on the rail. By separating these two grippers on the rail, the rectangular sheet can be spread out to be ready for the next processing step. If necessary, a part of the horizontal rail is tiltable so that the hanging second side can be held precisely vertically for facilitating the gripping of the lowermost end of the second side by the gripper on the vertical rail.

1 Claim, 8 Drawing Sheets

METHOD FOR SPREADING SHEETS

This application is a continuation of now abandoned application, Ser. No. 07/445,772 filed on Dec. 4, 1989, now abandoned.

BACKGROUND OF THE INVENTION

1. Field of the Invention

The present invention relates to a method for spreading thin soft rectangular articles such as bed sheets, diapers, table cloths, handkerchieves, cloth wrappers, dress materials, all other cloths, unwoven cloths, paper sheets, plastic sheets or the like (hereinafter generally called "rectangular sheets" throughout the specification and claims), and more particularly to a method for gripping corners of rectangular sheets that is available in a spreading apparatus for rectangular sheets, a sorting apparatus for linens or other textile goods, a spreading apparatus for linens or the like before laundry, and the like.

2. Description of the Prior Art

Generally, in a laundry factory, arriving bed sheets, towels, cover cloths and the like (hereinafter called "sheets") are washed as by a continuous washing machine, and thereafter they are charged into a drying machine through a dewatering step, as shown in FIG. 16. Then, sheets having passed through a drying step are untangled and spreaded out, and after they have been subjected to ironing, they are folded and shipped. At this time, between the drying step and the ironing step, sheets taken out of a drying machine are conveyed to a predetermined location by means of a belt conveyor, these sheets are picked and spreaded one by one from a block of sheets piled in heaps by a several workers, and then they are fed to an ironing apparatus or its auxiliary apparatus (spreader, feeder or the like).

A spreading work for sheets having finished a drying step is heavily laborious for workers under an unfavorable environment because it is a work within a high-temperature high-humidity atmosphere. Therefore, heretofore development of an apparatus for automating a spreading work for sheets has been desired, but such an automated apparatus does not exist in the industry at present, and as a prior art, only a fixed-position holding method for sheets was proposed in Japanese Patent Publication No. 59-24685 (1984).

This method consists of a first step of suspending a sheet while holding a part thereof, a second step of holding the lowermost end of the sheet suspended in the aforementioned first step and suspending the sheet while releasing the holding in the first step, a third step of holding the lowermost end of the sheet suspended in the second step, and a fourth step of gripping the sheet at the two points held in the above-mentioned second and third steps as stretched horizontally, and with respect to a rectangular sheet the method will be explained in more detail in the following.

If a rectangular sheet S is suspended while holding any arbitrary one point 027 thereon as shown in FIG. 17 in the first step, then a straight line passing through the held point 027 and a center of gravity 028 of the sheet S becomes vertical. Next, in the second step the sheet S is suspended while holding the lowermost point 029 under this condition and the holding in the first step is released. As the third step, then the sheet S takes the attitude shown in FIG. 18, and the distance between the top end 029 being held and the bottom end 030 of the sheet S becomes constant. Hence in the third step, the bottom end 030 shown in FIG. 18 is held. Next, in the fourth step if the top end 029 and the bottom end 030 which are the held points in the second and third steps, respectively, are held horizontally, the sheet S takes the state shown in FIG. 19. Under this condition one may consider that the sheet S has been held at fixed positions, and it could be transferred to the next process. However, in order to hold the sheet S under an undoubled spreaded condition, in a fifth step one of the bottom ends 031 and 032 in FIG. 19 is held and one of the previously held points 029 and 030 is released.

FIG. 20 is a schematic front view of a sheet fixed-position holding apparatus that is available upon practicing the above-described method for holding a sheet at fixed positions, and for convenience of explanation the subject apparatus is severed into four sections A, B, C and D. The construction of this sheet fixed-position holding apparatus is such that initial holding of a sheet and detection and holding of one corner of the sheet are carried out in the section A, detection and holding of another corner diagonally opposite to the corner held in the section A are carried out in the section B, in the sections B and C the sheet having its diagonally opposite two corners held is suspended with the diagonal kept horizontal and further holding of only one of the corners at the bottoms of the doubled sheet portion is carried out, and in the sections C and D adjacent two corners at the opposite ends of one edge of the sheet are held at the same level, and thereby the sheet S can be spreaded and held at fixed positions. In these figures, a stroking rod 035 is provided in the proximity of a terminal end of rightward movement of a chuck 033 so as to be movable vertically along a guide slot 036.

A chuck 037 is provided so as to be movable vertically along a guide slot 038 at a location under the terminal end of rightward movement of the chuck 033 and also to be movable from a lower dead point obliquely in the right-upward direction along the same guide slot 038. Another stroking rod 039 is provided so as to be movable vertically along a guide slot 040 in the proximity of an upper dead point of the oblique movement of the chuck 037. A chuck 041 is provided so as to be movable obliquely along a guide slot 042 with its lower dead point located under an upper dead point of the oblique movement of the chuck 037. A chuck 043 is provided so as to be movable vertically along a guide slot 044 at a location under a middle point of the line connecting the upper dead points of the respective oblique movements of the chucks, 037 and 041, and also so as to be movable obliquely along the same guide slot 044 with the uppermost point of the vertical movement placed at the lowermost point of the oblique movement. It is to be noted that the chucks 033, 037, 041 and 043 and the stroking rods 035 and 039 are driven along the respective guide slots by air cylinders not shown.

In order to hold a rectangular sheet at fixed positions by means of the above-described sheet fixed-position holding apparatus, the operation is carried out in the following sequence.

At first, in the state shown in FIG. 21, a part of a sheet 045 to be held at fixed positions is detected and held by the chuck 033, and this chuck 033 rises along a guide slot 034 then moves rightwards and becomes the state shown in FIG. 22. In the state shown in FIG. 22, as the lowermost end of the sheet 045 suspended by the chuck 033 would not always come right above the chuck 037, the sheet 045 is stroked by a stroking rod 035 including a circular ring having a notch at one portion so that the lowermost end of the sheet 045 (a corner portion of the sheet 045) may come right above the chuck 037 which is positioned right under the chuck 033. Thereby, when the chuck 037 rises, it can hold one of the corners of the rectangular sheet 045 at the lowermost end of the sheet as shown in FIG. 23. Thereafter the chuck 033 releases the sheet 045. Also, the chuck 037 lowers and then rises in the right upper direction along the guide slot 038. It is to be noted that at this moment the stroking rod 035 returns to an upper dead point of a guide slot 036.

In the state shown in FIG. 24, the sheet 045 suspended by the chuck 037 which has come to the upper dead point of the guide slot 038 and directed downwards, is again stroked by a stroking rod 039, and since the lowermost end (the corner diagonally opposite to the corner held by the chuck 037) of the sheet 045 comes to the position of a chuck 041 (a fixed position determined depending upon the size of the sheet 045), the end is detected and held by the chuck 041. The chuck 041 holding the lowermost end of the sheet 045 rises up to an upper dead point along a guide slot 042, and so, as shown in FIG. 25 two diagonally opposed corners of the sheet 045 are held at the same level (that is, horizontally). It is to be noted that at this moment the stroking rod 039 returns to an upper dead point of a guide slot 040.

Next, in the state shown in FIG. 25, the sheet 045 having its one diagonal held horizontally with the corners at the opposite ends of the diagonal gripped by the chucks 037 and 041, has one of two hanging corners gripped by a chuck 043 disposed at that position as opposed to the chuck 041, while the chuck 037 is released, and by raising the chuck 043 along a guide slot 044, the sheet 045 can be held at fixed positions in a vertically elongated attitude. It is to be noted that in this sheet fixed position holding apparatus, since the distance between the upper right end position of the chuck 037 and the lower left end position of the chuck 041 is adjusted to be nearly equal to the length of the diagonal of the sheet to be treated, in the event that the chuck 037 should have gripped two adjacent corners of the sheet 045 together in the state shown in FIG. 23, the chuck 041 could not grip the sheet 045, and so it is compelled to again repeat the above-described holding operation for the sheet 045.

However, the sheet gripping mechanism used in the sheet fixed-position holding apparatus in the prior art involved the following problems, That is, since the chucks 037, 041 and 043 are respectively disposed at fixed positions, the apparatus could spread only a rectangular sheet of predetermined sizes, and it was practically not useful for sheets in which various sizes of sheets were mixed.

In addition, as shown in FIG. 25, in order to made the chuck 043 grip one corner of the sheet 045 while being spreaded from the section B to the section C, it was essentially necessary to grip the sheet 045 with its diagonal stretched horizontally, and so, the entire apparatus necessitated a broad space. Furthermore, as the chucks 037 and 041 grip the lowermost ends of the sheet 045 always after the sheet was made to hang down in the direction of the gravity, at the gripped portions of the sheet, folds, creases, twists or the like would be necessarily generated, and in some cases they would adversely influenced upon finishment by the subsequent ironing apparatus or the like.

SUMMARY OF THE INVENTION

It is therefore one object of the present invention to provide an improved method for spreading a rectangular sheet which is free from the aforementioned shortcomings of the known method in the prior art.

A more specific object of the present invention is to provide a method and an apparatus for holding a rectangular sheet at fixed positions in preparation for spreading the same sheet, which can deal with rectangular sheets having various sizes, which do not necessitate a broad space, and which do not generate folds, creases, twists or the like at the gripped portions of the sheet and hence do not adversely influence upon finishment by the subsequent processing.

According to one feature of the present invention, there is provided a method for spreading a rectangular sheet, comprising the steps of suspending a part of a first edge including one corner of the rectangular sheet in the air while holding the aforementioned part nearly horizontally to thereby make a second edge including the above-mentioned one corner hang down nearly vertically, then holding the lowermost end of the second edge, thereafter releasing the aforementioned part of the first edge except for the above-mentioned one corner, and thereby holding two adjacent corners at the opposite ends of the second edge of the rectangular sheet.

According to another feature of the present invention, there is provided a method for spreading a rectangular sheet, comprising the steps of suspending a part of a first edge including one corner of the rectangular sheet in the air while holding the aforementioned part nearly horizontally, tilting the above-mentioned first edge by rotating about the above-mentioned one corner to thereby make a second edge including the above-mentioned one corner hang down vertically, then holding the lowermost end of the second edge, subsequently releasing a part or whole of the first edge, and thereby holding two adjacent corners at the opposite ends of the second edge of the rectangular sheet.

According to still another feature of the present invention, there is provided an apparatus for spreading a rectangular sheet, comprising a tiltable rail for stretching and holding a part of a first edge including one corner of the rectangular sheet nearly horizontally and tilting the aforementioned first edge by rotating about the abovementioned one corner to thereby make a second edge including the above-mentioned one corner hang down nearly vertically, elevator means including grippers which are vertically movable along the aforementioned second edge and adapted to grip the lowermost end of the second edge while moving up and down, and end detector means for detecting the lowermost end of the second edge.

In the case where the above-featured method and apparatus for holding a rectangular sheet at fixed positions are employed in the process of spreading rectangular sheets, rectangular sheets having various sizes can be dealt with without necessitating a broad space, moreover, folds, creases, twists or the like would not be produced at the gripped portions, and so, there is no fear that they would adversely influence upon finishment by the subsequent ironing apparatus or the like.

The above-mentioned and other objects, features and advantages of the present invention will become more apparent by reference to the following description of preferred embodiments of the invention taken in conjunction with the accompanying drawings.

Figure 1:
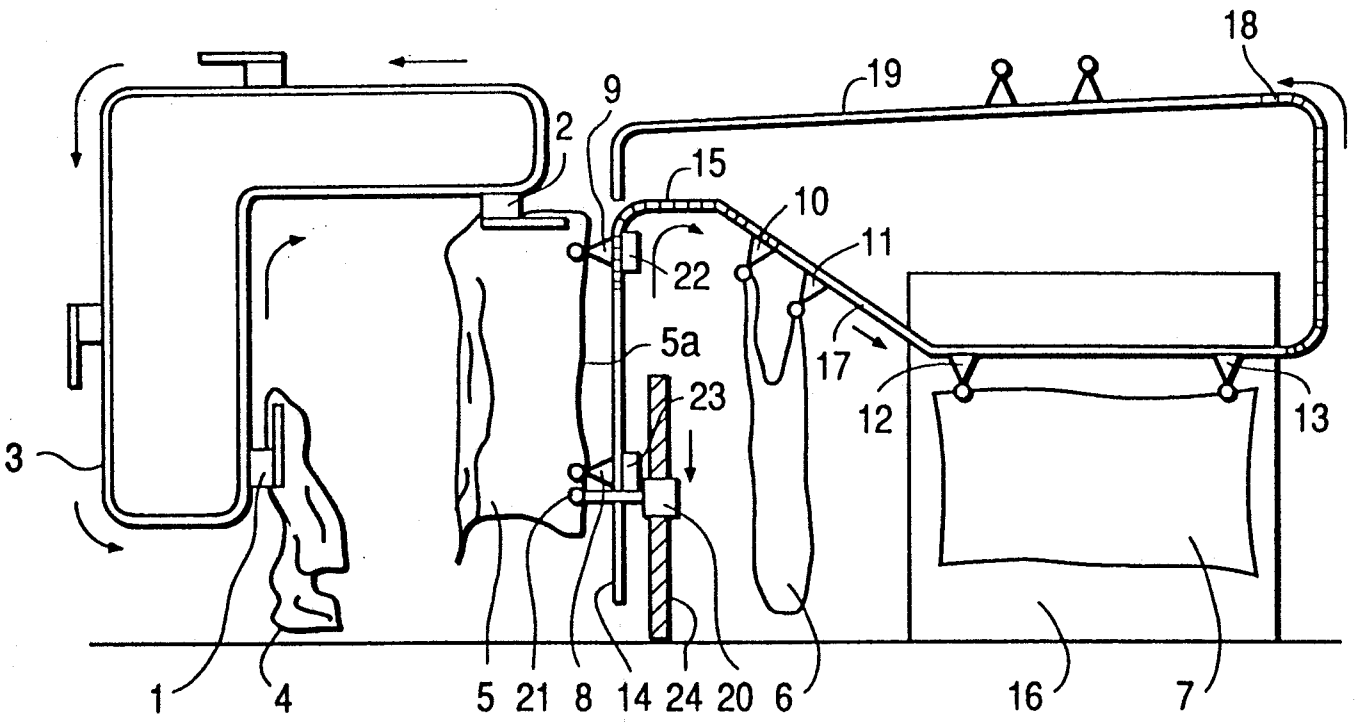
FIG. 1 is a schematic side view of a sheet spreading apparatus which practices a method according to a first preferred embodiment of the present invention.

DESCRIPTION OF THE PREFERRED EMBODIMENT:

Now a first preferred embodiment of the present invention will be described with reference to FIGS. 1 to 8. In these figures, reference numerals 1 and 2 designate sheet edge grippers such as those disclosed in, for instance, Laid-Open Japanese Utility Model Specification No. 63-90614 (1988), they are grippers mounted to an indexing-drive conveyor 3 and adapted to grip a part of a shorter edge ac of a rectangular sheet 4 including one corner a thereon as actuated by an operator. It is also possible to automate the gripping of the sheet edge. The conveyor 3 has the edge grippers 1 and 2 and the like mounted thereto at a desired pitch, it is driven in the direction of arrows as indicated in the figure, it can stop at a predetermined stop position, and also it can perform an indexing operation.

Reference numerals 4–7 designate rectangular soft sheets. It is to be noted that while the sheets 4–7 are identical, in order to facilitate to understand the respective steps they are differentiated by different reference numerals. Reference numerals 8–13 designate corner grippers, which are movable along a vertical rail 14, rails 17 and 19, and conveyor rails 15 and 18 while gripping the corners (a and b, or a and c) of the sheets 4–7. These corner grippers 8–13 could be any known ones such as the sheet conveying chucks proposed in Laid-Open Japanese Utility Model Specification No. 63-104310 (1988). The vertical rail 14 is a guide rail for moving a corner gripper 8 up and down along a hanging longer edge of a sheet 5. The above-mentioned rails 17 and 19 are such rails that the corner grippers 8–13 can move thereon by rolling due to their own gravities. Reference numeral 16 designates a feeding device, which is a device for stretching and spreading a sheet 6 carried in as gripped by corner grippers 10 and 11 into the state of a sheet 7 by broadening an interval between corner grippers 12 and 13, and then feeding the sheet 7 to a roll type ironing apparatus in the subsequent step. This apparatus could be a known apparatus in the prior art as disclosed in Japanese Patent Publication No. 58-22240 (1983).

Reference numeral 20 designates an elevator bracket which is moved up and down along the vertical rail 14 by means of an elevator device 24 consisting of a ball screw and a nut or the like, at the tip end of the bracket 20 is mounted a corner detector 21 consisting of a photo-electric sensor for detecting the lowermost end of the sheet 5, and further is mounted a known opener 23 (for instance, Laid-Open Japanese Utility Model Specification No. 63-104310 (1988)) for opening and closing the corner gripper 8. As the opener 23, a device disclosed in the above-referred laid-open U.M. specification can be utilized. The elevator bracket 20 moves up and down along the vertical rail 14 while supporting the movable gripper 8, and at the position where the lowermost end of the hanging sheet 5 has been detected by the corner detector 21, it makes the gripper 8 grip the hanging sheet 5. The detector 21 is a sensor such as a photo-electric sensor, a limit switch or the like which can detected the lowermost end of the sheet. Reference numeral 22 designates an opener fixed in position to the rail 14 for making the corner gripper 9 grip the upper corner of the sheet 5.

Figure 5:
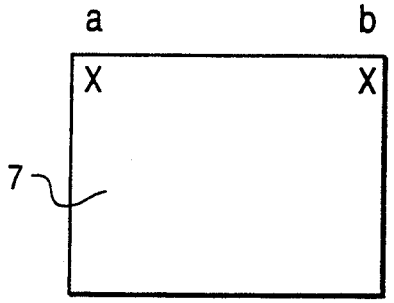

Now description will be made on the operation of the first preferred embodiment of the present invention constructed in the above-described manner. At first, the operation will be explained with respect to the case where a rectangular sheet 7 is spreaded with its longer edge ab placed at the upper edge as shown in FIG. 5.

Figure 2:
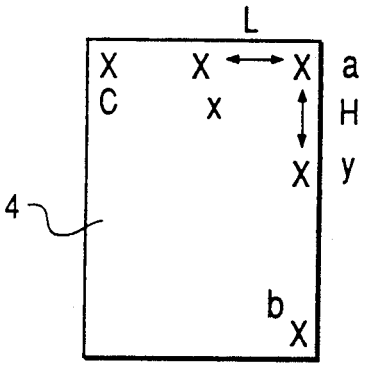
FIGS. 2 to 8 are schematic views for explaining the successive steps in the method for spreading a rectangular sheet according to the first preferred embodiment illustrated in FIG. 1.
Figure 3:
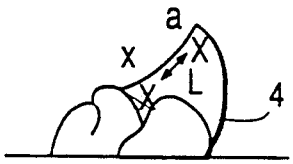

1 An operator makes an edge gripper 1 grip an edge portion L of a rectangular sheet 4 which portion is a part of one shorter edge including one corner a as shown in FIG. 2. In this case, the edge portion L could be gripped by one edge gripper after having been stretched straightly, or else a point a and a point x at the opposite ends of the edge portion L could be gripped separately by two grippers and held after being spreaded in the next step (FIG. 3).

Figure 4:
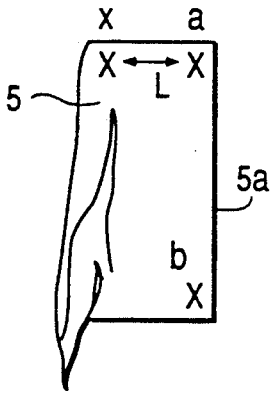

2 The edge portion L gripped in Step 1 above is held horizontally in the air as shown in FIG. 4. In this case, the edge portion L could be held as stretched and spreaded by two grippers in the air as described above. If a rectangular sheet is held in the air in the above-described manner, then as shown in FIG. 4, the side of a longer edge 5*a* of the rectangular sheet 5 including the one corner a would necessarily hang down nearly vertically under the one corner a due to the gravity. Accordingly, regardless of the size of the sheet, a corner b adjacent to the one corner a on the longer edge would be always positioned at the lowermost end of the sheet 5 along the hanging longer edge 5*a* nearly right under the one corner a.

3 If the gripper 8 moves up and down along the hanging longer edge 5*a* under the one corner a, then it can detect and grip the corner b which is the lowermost end of the sheet 5.

4 Subsequently, in the case where the edge portion L is held gripped by one edge gripper, only the one corner a is regripped by the gripper 9 and the edge portion L is released. Otherwise, in the case where the point a and the point x at the opposite ends of the edge portion L are held gripped by separate grippers, only the point x is released and the point a is regripped by the gripper 9. Then the state where only the point a and the point b are gripped by the grippers 9 and 8, respectively, is realized, and so, if these two points are separated horizontally in the air, then as shown in FIG. 5, the rectangular sheet 7 can be stretched and spreaded with its longer edge ab placed at the upper edge.

5 As described above, if the point a and the point b are gripped by the grippers 9 and 8, respectively, since the sheet 7 can be gripped under a stretched and spreaded condition, pretty and precise gripping would become possible in distinction from the gripping under a folded, creased or twisted condition of corners in the prior art.

Figure 8:
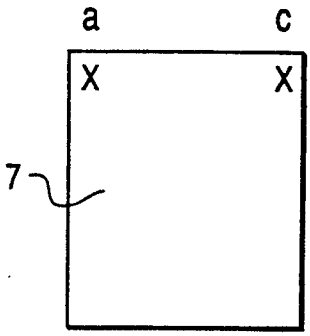

Next, the operation will be explained with respect to the case where a rectangular sheet is spreaded with its shorter edge ac placed at the upper edge as shown in FIG. 8.

Figure 6:
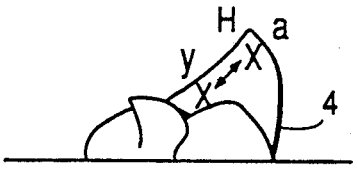

6 An edge portion H of a rectangular sheet 4 which portion is a part of one longer edge including one corner a is gripped by an edge gripper 1. In this case, the edge portion H could be gripped by one edge gripper after having been stretched straightly, or else a point a and a point y at the opposite ends of the edge portion H could be gripped separately by two grippers and held after being spreaded in the next step (FIG. 6).

Figure 7:
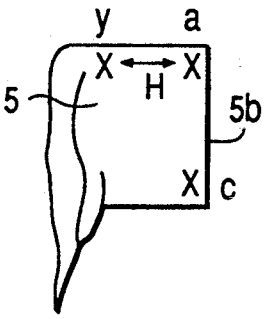

7 The edge portion H gripped in Step 6 above is held horizontally in the air as shown in FIG. 7. In this case, the edge portion H could be held as stretched and spreaded by two grippers in the air as described above. If a rectangular sheet is held in the air in the above-described manner, then as shown in FIG. 7, the side of a shorter edge 5*b* of the rectangular sheet 5 including the one corner a would necessarily hang down nearly vertically under the one corner a due to the gravity. Accordingly, regardless of the size of the sheet, a corner c adjacent to the one corner a on the shorter edge would be always positioned at the lowermost end of the sheet 5 along the hanging shorter edge 5*b* nearly right under the one corner a.

8 If the gripper 8 moves up and down along the hanging shorter edge 5*b* under the one corner a, then it can detect and grip the corner c which is the lowermost end of the sheet 5.

9 Subsequently, in the case where the edge portion H is held gripped by one edge gripper, only the one corner a is regripped by the gripper 9 and the edge portion H is released. Otherwise, in the case where the point a and the point y at the opposite ends of the edge portion H are held gripped by separate grippers, only the point y is released and the point a is regripped by the gripper 9. Then the state where only the point a and the point c are gripped by the grippers 9 and 8, respectively, is realized, and so, if these two points are separated horizontally in the air, then as shown in FIG. 8 the rectangular sheet 7 can be stretched and spreaded with its shorter edge ac placed at the upper edge.

10 Therefore, the same advantage over the method in the prior art as described in Section 5 above can be obtained.

Next, a second preferred embodiment of the present invention will be described with reference to FIGS. 9 to 15.

In these figures, reference numeral 101 designates a sheet gripping device such as, for instance, the device disclosed in Laid-Open Japanese Utility Model Specification No. 63-90614 (1988). Grippers 102, 103, 102', 103', . . . moving along a rail 109 are successively fed to the sheet gripping device 101. Among these grippers, grippers 102' and 103' arriving at the illustrated positions are opened by means of air cylinders not shown, and when an operator 115 inserts a corner portion of one sheet 104' on a conveyor 111 for conveying sheets 104'' into these opened grippers 102' and 103' (into a sheet charging port), the grippers 102' and 103' would automatically grip the sheet 104'. Under this condition, if the sheet gripping device 101 is rotated by 90° in the horizontal plane, then the state of gripping a sheet 104 by grippers 102 and 103 as shown in FIG. 10(*b*) is realized, and at this moment, other empty grippers are fed to the same position (the position of the grippers 102' and 103' in FIG. 9) and opened in a similar manner. In addition, reference numerals 122 and 123 in FIG. 11 designate grippers for gripping end portions of a vertical side edge. On the other hand, the above-mentioned sheet 104' is a sheet having a portion close to one corner gripped by the grippers 102' and 103', while sheets 104 and 107 are sheets gripped by grippers 102 and 103 at the positions separated by about 50 cm from each other, a sheet 110 is a sheet having a part of its edge A suspended nearly horizontally, and a sheet 141 is a sheet gripped by grippers 132 and 133, respectively, at the positions close to the opposite ends of one edge.

Reference numeral 105 designates a stroking rod, which is a rod used for stroking a sheet 104 when the sheet 104 fed to a sheet charging port (FIG. 10(*a*)) was rotated by 90° by the sheet gripping device 101 (FIG. 101 (*b*)) and then the gripper 102 is raised upwards by about 50 cm by means of an air cylinder not shown (FIG. 10(*c*)). At this time the gripper 103 opens to guide the sheet 104, and thereafter it closes to grip the sheet 104. Reference numerals 106 and 129 designate drive rails, which are rails associated with drive units for raising the grippers 102, 103, 122 and 123 as disclosed, for instance, in Laid-Open Japanese Utility Model Specification No. 63-90614 (1988). In addition, reference numeral 108 designates a corner revealing device which serves to untangle a corner portion of a suspended sheet 107, and it is adapted to reveal a corner of a sheet by beating an edge of the sheet.

Reference numeral 121 designates a tiltable rail, which is a rail capable of being subjected to tilting motion about a fulcrum pin 120 by means of an air cylinder 125 (FIG. 11(*b*)) as shown in FIG. 11. Reference numeral 124 designates another rail contiguous to the tiltable rail 121, which accepts a gripper 102 gripping one corner of a sheet 110 (FIG. 11(*b*)) and fixes the position of the gripper 102 by means of a stopper not shown. Reference numeral 126 designates a gripper feeder which accepts grippers 112 and 113 being fed from a rail 143 into the feeder and after they have been rotated by 180° means of an indexing device 127, these grippers 112 and 113 are fed into the vertical rail 128. This device is similar to that disclosed, for example, in Laid-Open Japanese Utility Model Specification No. 63-139864 (1988). Reference numeral 145 designates an elevator device which involves a drive unit for moving an elevator bracket 130 up and down.

Reference numeral 130 designates an elevator bracket, which is moved up and down along a vertical rail 128 by the elevator device 145, and to the tip end of the elevator bracket 145 is mounted a corner detector device 131 such as a photo-electric sensor or the like for detecting the lowermost end of the sheet 110. In addition, an opener 135 for opening and closing a corner gripper 122 such as disclosed, for instance, in Laid-Open Japanese Utility Model Specification No. 63-104310 (1988), is also mounted to the bracket 130. The elevator bracket 130 moves up and down while supporting the corner gripper 122 which is movable along the vertical rail 128, and at the position where the lowermost end of the hanged sheet 110 has been detected by the corner detector device 131, the elevator bracket 130 makes the gripper 122 grip the lowermost end of the sheet 110. Reference numeral 134 designates an edge detector device (FIGS. 11(*b*) and 11(*c*)), which is a device for detecting the fact that an edge B of the sheet 110 has been hanged vertically when the tiltable rail 121 is tilted, and normally a photo-electric tube is used for this device. In addition, reference numeral 142 in FIG. 9 designates a sheet feeder which makes grippers 132 and 133 move to the left and to the right, and thereafter feeds a sheet to the subsequent step under a spreaded condition by releasing the gripping.

Figure 9:
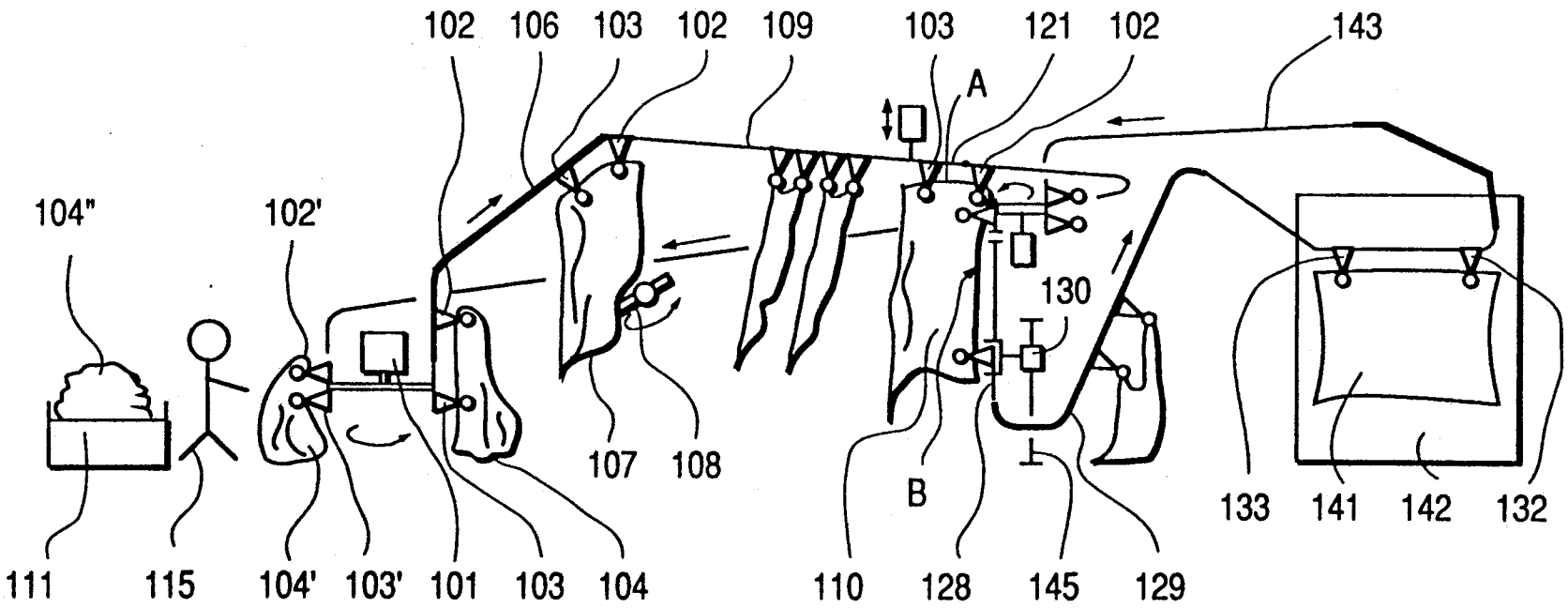
FIG. 9 is a schematic side view of a sheet spreading apparatus which practices a method according to a second preferred embodiment of the present invention.
Figure 10A:
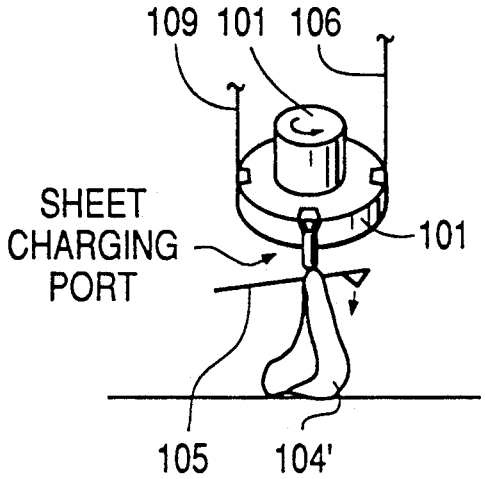
FIGS. 10(*a*), 10(*b*), 10(*c*) and 10(*d*) are perspective views showing successive steps at a bed sheet charging station.
Figure 10B:
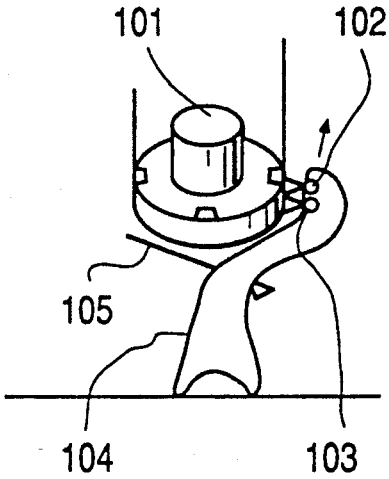
Figure 10C:
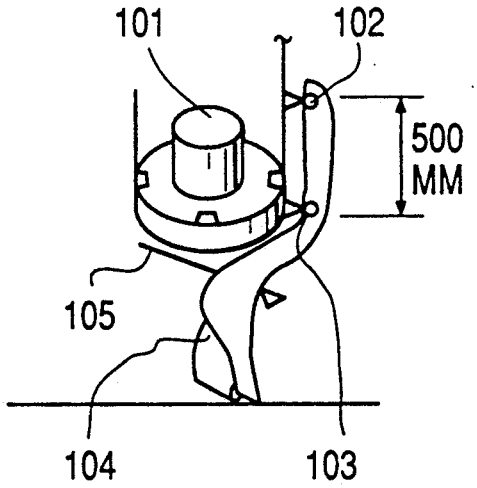
Figure 10D:
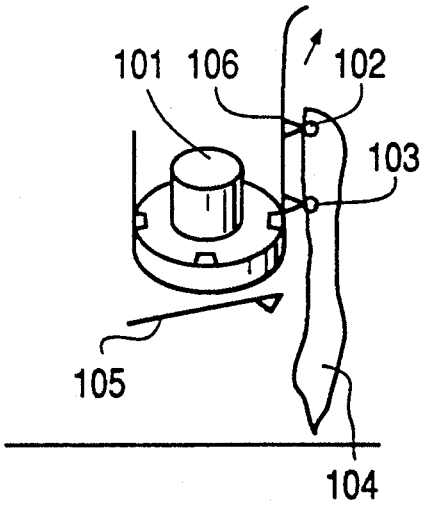
Figure 11A:
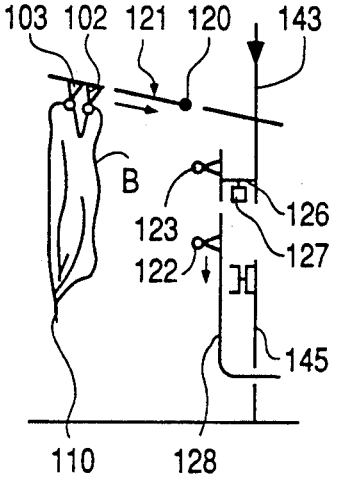
FIGS. 11(*a*), 11(*b*), 11(*c*), 11(*d*) and 11(*e*) are schematic views showing successive steps at an essential section in the apparatus shown in FIG. 9.
Figure 11B:
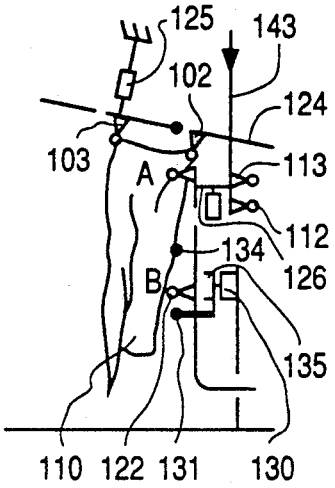
Figure 11C:
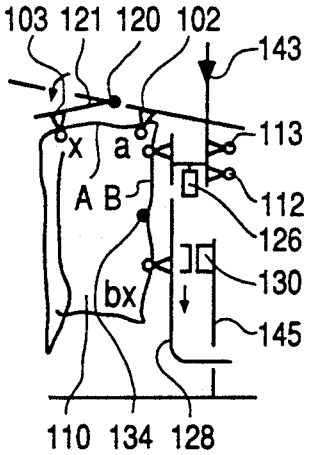
Figure 11D:
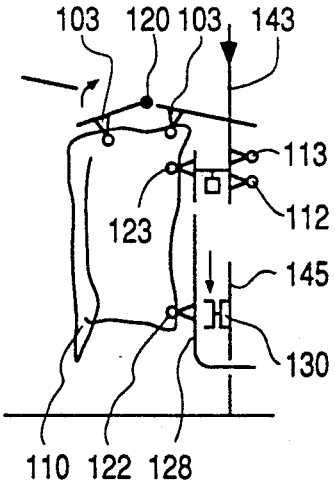
Figure 11E:
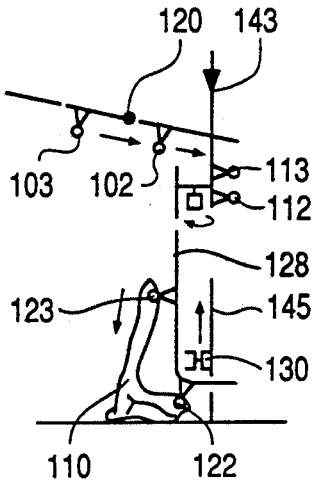
Figure 12:
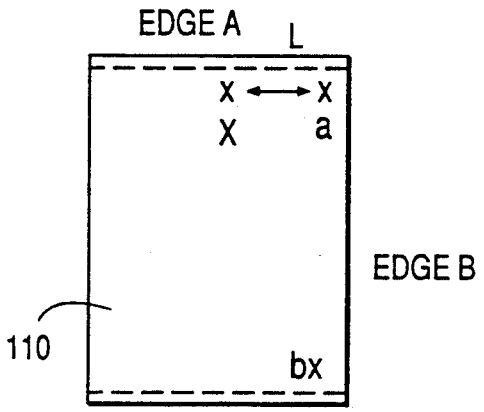
FIGS. 12, 13, 14 and 15 are schematic views showing successive steps in the process of regripping a sheet as changing its direction by 90° in the method according to the present invention.

Next, the operation of the above-described apparatus will be explained with reference to FIGS. 9 to 15. At first, as shown in FIG. 9, an operator 115 picks up one of the sheets 104'' on the conveyor 111, and inserts a point a at the end of one edge (FIG. 12) into a sheet charging port (FIG. 10(*a*)). Grippers 102' and 103' have been preliminarily fed to the sheet charging port and opened, and when the feed of one sheet 104' has been detected as by a photo-electric tube or the like not shown, they are automatically closed. In response to a signal representing the closure of the grippers, the sheet gripping device 101 rotates by 90° (FIG. 10(*b*)), then while a gripper 102 is held gripping the sheet 104, the other gripper 103 is opened by an air cylinder not shown, and fixed in position. Under this condition, the gripper 102 is pushed up by about 50 cm by means of another air cylinder not shown (FIG. 10(*c*)), and the gripper 103 is closed. Through these operations, the gripper 103 can automatically grip a point x of the sheet 110 shown in FIG. 13. It is to be noted that the distance between the point a and the point x is properly selected to be 50 cm±20 cm.

At this time, a stroking rod 105 is pushed out so as to perform the action of stroking the sheet 104, so that the sheet 104 would not disengage from the gripper 103 and the sheet 104 can be gripped precisely at the point x. Thereafter, the stroking rod 105 is returned to its original position, and the sheet gripping device 101 becomes ready to accept the next succeeding sheet 104 (FIG. 10(*d*)). A sheet 107 having its point a and point x gripped by the grippers 102 and 103 is raised by the drive rail 106 and is conveyed while being hanged in the air. In the midst of this conveyance is provided a corner revealing device 108. The sheet 107 is beated by this corner revealing device 108 and thereby untangled, and so a point b at the corner portion can be revealed under the gripper 102. The sheet 110 having its corner point b revealed is conveyed as gripped by the grippers 102 and 103, and these grippers 102 and 103 are conveyed onto the tiltable rail 121.

Figure 13:
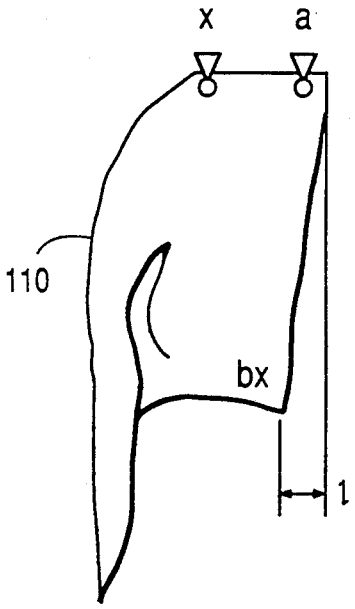
Figure 14:
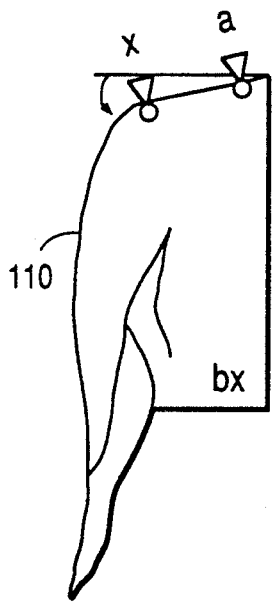
Figure 15:
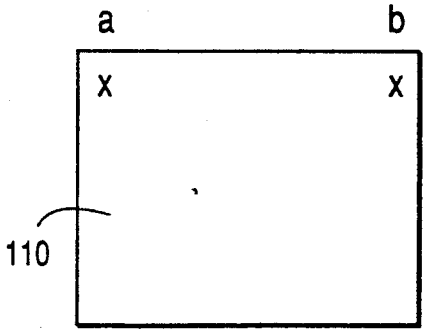
Figure 16:
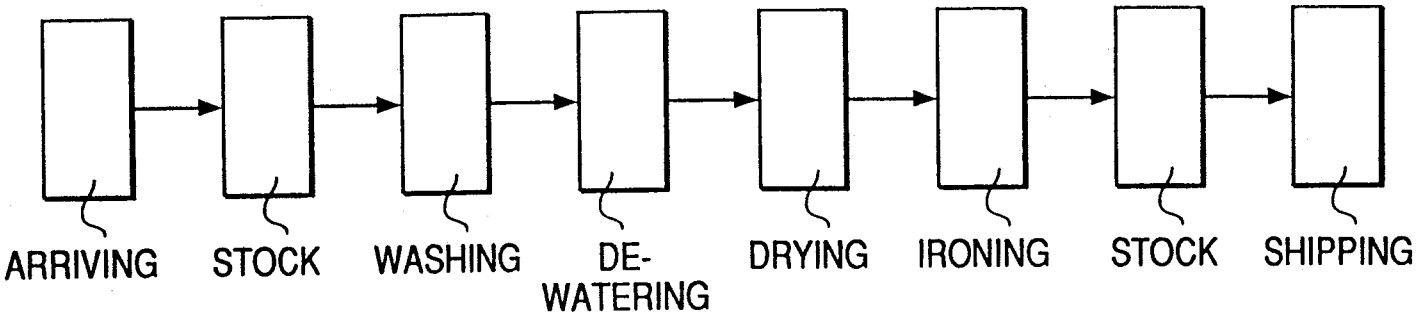
FIG. 16 (PRIOR ART)
FIG. 16 is a block diagram showing the successive steps for sheets from arriving to shipping in a laundry factory in the prior art.
Figure 18:
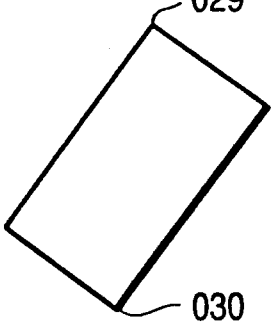
FIG. 18 (PRIOR ART)
FIGS. 17, 18 and 19 are schematic views showing successive steps for explaining a principle of a method for gripping a rectangular sheet at fixed positions in the prior art.
Figure 19:
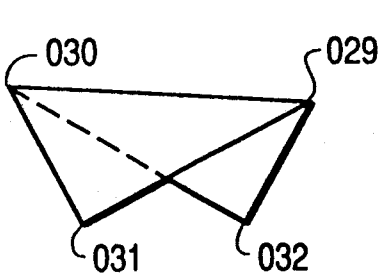
FIG. 19 (PRIOR ART)
Figure 17:
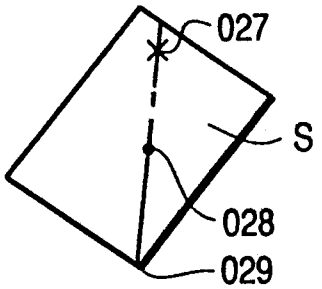
FIG. 17 (PRIOR ART)
Figure 21:
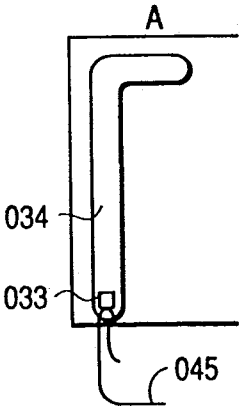
FIG. 21 (PRIOR ART)
FIGS. 21, 22, 23, 24 and 25 are schematic partial side views of the same apparatus in the prior art showing successive steps in the process of gripping a rectangular sheet at fixed positions.
Figure 25:
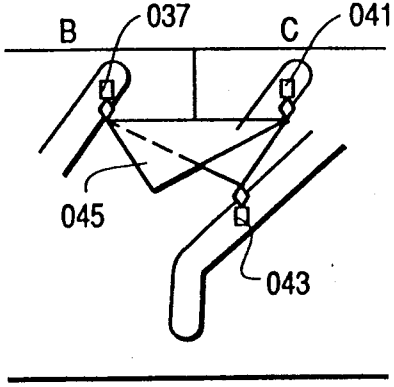
FIG. 25 (PRIOR ART)
Figure 20:
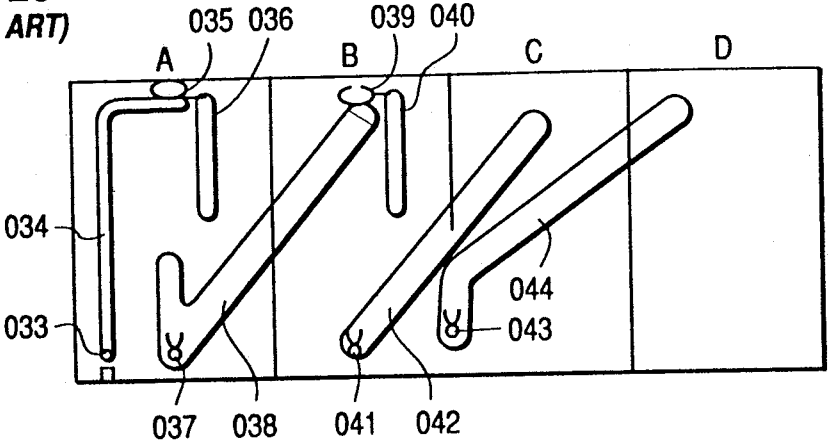
FIG. 20 (PRIOR ART)
FIG. 20 is a schematic side view of a sheet spreading apparatus in the prior art.
Figure 24:
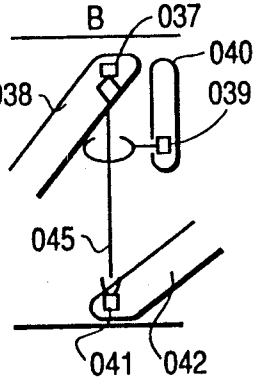
FIG. 24 (PRIOR ART)
Figure 23:
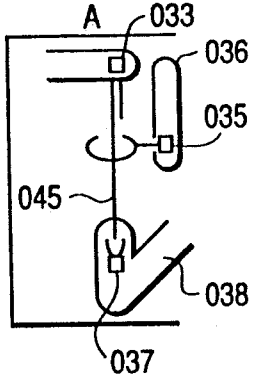
FIG. 23 (PRIOR ART)
Figure 22:
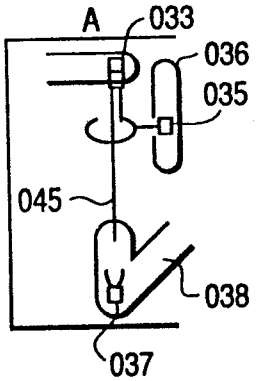
FIG. 22 (PRIOR ART)

Here, if the point a and the point x are held horizontally, that is, at the same level as shown in FIG. 13, then since the center of gravity of the sheet 110 is located at a position deviated from the gripped points a and x, the corner point b would be at a position displaced horizontally by 1 cm from the top of the right edge of the sheet 110 as shown in FIG. 13. This distance of displacement is about 40 cm at the maximum in the case where the shorter edge A of the sheet 110 is 2 m and the longer edge A thereof is 3 m, and this will vary depending upon sizes, a residual moisture proportion, gripping positions at the point a and the point x, and the like of the sheet.

Accordingly, in order to grip precisely the end point b of the side edge B, the gripper 102 conveyed onto the tiltable rail 102 is further sent onto the rail 124 and fixed in position as shown in FIG. 11(*b*). Subsequently, an air cylinder not shown is made to act so that the edge portion of the sheet 110 between the gripped points a and x may be stretched on the tiltable rail 121, and also the tiltable rail 121 is made to tilt about a pin 120 at the fulcrum point (FIG. 11(*c*)). The tilt angle is controlled by means of the edge detector device 134.

After the side edge B has hanged nearly vertically, the elevator bracket 130 descends along the vertical rail 128. The descended elevator bracket 130 stands by jointly with the gripper 122 at the position where the point b on the side edge B of the sheet 110 can be gripped. The elevator bracket 130 descends by a distance corresponding to the length of the side edge B of the sheet 110, and so, even a sheet having a different length can be gripped by the gripper 122 precisely at the corner point b (FIG. 11(*d*)). Thereafter, the rail 124, and the grippers 102 and 103 on the tiltable rail 121 are released by actions of air cylinders not shown, and the sheet 110 descends along the vertical rail 128 as gripped by the grippers 122 and 123 at the point a and the point b.

The descended grippers 122 and 123 (FIG. 11(*e*)) are raised by the drive rail 129, and fed to the sheet feeder 142 as shown in FIG. 9. The grippers 122 and 123 are automatically separated to the left and the right, their gripping is released, and the sheet is fed to a roll ironer or the like in the subsequent step under a spreaded condition. It is to be noted that the method of spreading a sheet according to the present invention is applicable to either a rectangular sheet or a square sheet. In addition, it is also becomes possible by changing the arrangement of rails that the gripper 102 is continuously used in place of the gripper 123 and the opposite end portions of the side edge B are gripped by the grippers 102 and 122. While the preferred embodiments were explained above in connection to rectangular sheet, even in the case of a square sheet, gripping of corners can be achieved in the similar manner.

As described in detail above, since the present invention is characterized by a number of novel features, according to the present invention even a bag-shaped sheet (a blanket cover or the like), spreading of the sheet is possible provided that the contour of the sheet is rectangular, and also the invention is applicable even to a group of sheets in which sheets having various sizes are mixed. Furthermore, according to the present invention, since the opposite ends of one side edge are gripped, there is no need to hold the length of a diagonal of a rectangular sheet, but spreading of a sheet can be achieved automatically if a part of one side edge is initially supported, and therefore, the apparatus becomes compact and space-saving. In addition, as the gripped corner of a sheet is gripped by a gripper after having been stretched and spreaded, the inconvenience that folds, creases, twists and the like may be generated, is not present.

Although in a laundry factory, spreading of sheets (linens) and sorting works for sheets relied upon human labor in the prior art, according to the present invention, a worker need not untangle the whole of a sheet, but if he spreads out only a part of one edge and makes it gripped by a gripper, the sheet can be automatically spreaded, and therefore, the worker can be released from a work under a hygienically bad environment, and energy saving at a laundry factory can be achieved.

While a principle of the present invention has been described above in connection to preferred embodiments of the invention, it is intended that all matter contained in the specification and illustrated in the accompanying drawings shall be interpreted to be illustrative and not as a limitation to the scope of the invention.

What is claimed is:

1. A method of spreading a rectangular sheet, said method comprising the steps of:

gripping the rectangular sheet at at least first and second points, the first of which points is located adjacent a first corner of the rectangular sheet so as to also be adjacent first and second side edges of the sheet intersecting at said first corner and the second of which points is spaced from said first corner and is located adjacent said first side edge of the sheet, while orienting that portion of the first side edge extending adjacent the at least first and second points substantially horizontally in the air so as to suspend the sheet in a manner in which said second side edge of the sheet hangs substantially vertically from said first corner;

subsequently gripping the sheet at a third point adjacent a second corner thereof located at the lowermost end of said second side edge of the sheet and at a fourth point adjacent said first corner and adjacent said second edge at the uppermost end thereof; and thereafter releasing the sheet at least at said first and second points while holding said sheet at said third and fourth points.

* * * * *

UNITED STATES PATENT AND TRADEMARK OFFICE

CERTIFICATE OF CORRECTION

PATENT NO. : 5,169,282

DATED : December 8, 1992

INVENTOR(S) : Atsushi Ueda, et.al.

It is certified that error appears in the above-indentified patent and that said Letters Patent is hereby corrected as shown below:

On the Title page, item [22], change application no. to -- 780,459--.

Signed and Sealed this

Ninth Day of November, 1993

Bruce Lehman

*Attest:*

BRUCE LEHMAN

*Attesting Officer*

*Commissioner of Patents and Trademarks*